US010497203B2

(12) United States Patent
Elmqvist

(10) Patent No.: US 10,497,203 B2
(45) Date of Patent: Dec. 3, 2019

(54) GAMING MACHINE HAVING MULTIPLE REEL FEATURES AND METHODS OF OPERATING SAME

(71) Applicant: Yggdrasil Malta Ltd., Sliema (MT)

(72) Inventor: Fredrik Elmqvist, Sliema (MT)

(73) Assignee: Yggdrasil Malta Ltd., Sliema (MT)

( * ) Notice: Subject to any disclaimer, the term of this patent is extended or adjusted under 35 U.S.C. 154(b) by 0 days.

(21) Appl. No.: 15/422,891

(22) Filed: Feb. 2, 2017

(65) Prior Publication Data

US 2018/0218564 A1 Aug. 2, 2018

(51) Int. Cl.
*G07F 17/32* (2006.01)
*G07F 17/34* (2006.01)

(52) U.S. Cl.
CPC ..... *G07F 17/3213* (2013.01); *G07F 17/3225* (2013.01); *G07F 17/3244* (2013.01); *G07F 17/34* (2013.01)

(58) Field of Classification Search
CPC ..... G07F 17/3213; G07F 17/3225; G07F 17/3244; G07F 17/34
See application file for complete search history.

(56) References Cited

U.S. PATENT DOCUMENTS 5,766,074 A * 6/1998 Cannon ..... G07F 17/3211 463/16
5,930,384 A * 7/1999 Guillemaud ..... G06T 11/006 250/363.04
5,931,467 A * 8/1999 Kamille ..... A63F 3/065 273/139
5,980,384 A * 11/1999 Barrie ..... G07F 17/3265 273/138.1
6,027,115 A * 2/2000 Griswold ..... G07F 17/3211 273/143 R
6,033,307 A * 3/2000 Vancura ..... G07F 17/32 273/138.2
6,059,289 A * 5/2000 Vancura ..... G07F 17/32 273/143 R
6,089,977 A * 7/2000 Bennett ..... G07F 17/34 273/143 R
6,095,921 A * 8/2000 Walker ..... G07F 17/32 273/138.2

(Continued)

*Primary Examiner* — Omkar A Deodhar
*Assistant Examiner* — Matthew D Hoel
(74) *Attorney, Agent, or Firm* — Howard & Howard Attorneys PLLC

(57) ABSTRACT

A system and method for providing a game to a player is described herein. The system includes a controller that is configured to display a game on the display device including a plurality of reels with each of the reels including a plurality of symbols. The controller initiates a first instance of the game, select a first primary reel feature set, and generates a first reel feature combination including the selected first primary reel feature set. The controller displays the game on the display device including a plurality of reels including a plurality of symbols and a host character associated with the selected first primary reel feature set, randomly generate an outcome of the first instance of the game including reel features included in the selected first primary reel feature set, and provides an award to the player as a function of the outcome.

20 Claims, 15 Drawing Sheets

(56) References Cited

U.S. PATENT DOCUMENTS 6,102,798 A * 8/2000 Bennett ..... G07F 17/34 463/16
6,142,874 A * 11/2000 Kodachi ..... G07F 17/32 273/121 B
6,224,482 B1 * 5/2001 Bennett ..... G07F 17/32 273/143 R
6,251,013 B1 * 6/2001 Bennett ..... G07F 17/3211 273/143 R
6,270,411 B1 * 8/2001 Gura ..... G07F 17/3211 273/138.2
6,290,600 B1 * 9/2001 Glasson ..... G07F 17/3265 273/143 R
6,319,124 B1 * 11/2001 Baerlocher ..... G07F 17/3211 273/138.1
6,375,570 B1 * 4/2002 Poole ..... G07F 17/3211 463/20
6,506,114 B1 * 1/2003 Estes ..... G07F 17/32 273/138.1
6,517,432 B1 * 2/2003 Jaffe ..... G07F 17/32 463/16
6,551,187 B1 * 4/2003 Jaffe ..... G07F 17/32 463/16
6,554,704 B2 * 4/2003 Nicastro ..... G07F 17/32 273/143 R
6,558,254 B2 * 5/2003 Baelocher ..... G07F 17/3211 273/138.1
6,561,900 B1 * 5/2003 Baerlocher ..... G07F 17/34 273/143 R
6,692,356 B2 * 2/2004 Baerlocher ..... G07F 17/3211 463/20
6,786,818 B1 * 9/2004 Rothschild ..... G07F 17/32 436/16
6,837,790 B1 * 1/2005 Kaminkow ..... G07F 17/3211 463/20
7,156,740 B2 * 1/2007 Kaminkow ..... G07F 17/3211 463/16
7,192,345 B2 * 3/2007 Muir ..... G07F 17/3244 463/20
7,559,837 B1 * 7/2009 Yoseloff ..... G07F 17/3265 273/143 R
7,625,281 B2 * 12/2009 Bilyeu ..... G07F 17/3262 463/20
7,980,936 B2 * 7/2011 Mead ..... G07F 17/32 463/16
8,105,145 B2 * 1/2012 Jaffe ..... G07F 17/3265 273/143 R
8,360,846 B1 * 1/2013 Bennett ..... G07F 17/32 463/20
8,408,989 B2 * 4/2013 Bennett ..... G07F 17/32 463/20
9,123,210 B2 * 9/2015 Bennett ..... G07F 17/32
2002/0016200 A1 * 2/2002 Baerlocher ..... G07F 17/32 463/20
2003/0017865 A1 * 1/2003 Beaulieu ..... G07F 17/32 463/16
2003/0064802 A1 * 4/2003 Rodgers ..... G07F 17/3265 463/30
2003/0069063 A1 * 4/2003 Bilyeu ..... G07F 17/32 463/20
2004/0048646 A1 * 3/2004 Visocnik ..... G07F 17/32 463/16
2013/0217466 A1 * 8/2013 Fujisawa ..... G07F 17/3267 463/20
2013/0217468 A1 * 8/2013 Fujisawa ..... G07F 17/3267 463/20
2013/0217469 A1 * 8/2013 Fujisawa ..... G07F 17/3267 463/20
2013/0244751 A1 * 9/2013 Bennett ..... G07F 17/32 463/20
2016/0063807 A1 * 3/2016 Bennett ..... G07F 17/32 463/22

* cited by examiner

30

| 34 | 36 | |
|---|---|---|
| Reel Feature ID | Reel Feature Data | |
| 32 001 | Synced Reels | Reelfeature001.ext |
| 002 | Spreading Wilds | Reelfeature002.ext |
| 32 003 | Stacked Symbol | Reelfeature003.ext |
| 004 | Treasure Chest | Reelfeature004.ext |
| 005 | 1 Sticky Respin | Reelfeature005.ext |
| 006 | Stacked Wilds on Highest Reels | Reelfeature006.ext |
| 007 | Win Both Ways | Reelfeature007.ext |
| 008 | x3 Wild Multiplier | Reelfeature008.ext |
| 009 | Top Paying Symbol = Wild | Reelfeature009.ext |
| 010 | x1, x2, x3, or x5 Multiplier | Reelfeature010.ext |

FIG. 9

38

| 42 | 44 | 46 | 48 | 50 | | 52 |
|---|---|---|---|---|---|---|
| Reel Feature Set ID | Selection Probability | Host Feature Character | Reel Matrix | Host Reel Feature Sets | | Guest Bonus Reel Feature |
| 40 Set001 | 10% | Character A | 3x3x4x3x3 | 001 | 002 | 009 |
| 40 Set002 | 15% | Character B | 3x3x4x3x3 | 003 | 004 | 005, 009 |
| Set003 | 25% | Character C | 3x3x4x3x3 | 005 | 006 | 002; 007; 009 |
| Set004 | 25% | Character D | 3x4x4x4x3 | 007 | 008 | 001; 002; 004; 009 |
| Set005 | 25% | Character E | 4x3x3x3x4 | 009 | 010 | 001; 002; 004; 008 |

FIG. 10

54

| | Feature Group | Description | Selection Probability |
|---|---|---|---|
| | Host Reel Feature Sets Only | | |
| 56 | FeatureGroup001 | Host Reel Feature Set | 50% |
| 56 | FeatureGroup002 | Add Guest Bonus Reel Feature | 25% |
| | FeatureGroup003 | New Feature Reel Set + Bonus Reel Feature | 25% |
| | Host Reel Feature Sets + Guest Bonus Feature | | |
| | FeatureGroup004 | Previous Reel Feature Combination | 50% |
| | FeatureGroup005 | Host Reel Feature Set Only | 25% |
| | FeatureGroup006 | New Reel Feature Set | 25% |

FIG. 11

38

40

| 46 Host Character | 48 Ream Characteristics | 50 1st Reel Feature | 50 2nd Reel Feature | 52 Bonus Reel Combinations |
|---|---|---|---|---|
| Character A: Mowgli | 3x3x4x3x3 | **Synced reels**<br><br>**Feature effect:**<br>(Adjacent reels of the same height)<br>R1+R2 & R4+R5 in this realm<br><br>**Animation Presentation:**<br>Mowgli grabs on to vines and pulls down which wrap tightly around the reels which will be synced with one another<br><br>Animation Sequence: First<br>Occurrence: 1 TIME | **Spreading Wilds**<br><br>**Feature effect**:<br>(Spreading to 1 or 2 more positions).<br>Wild is present only on R3 in this mode<br><br>**Animation Presentation:**<br>▪ Wilds are presented on the centre of the screen glowing.<br>• Mowgli grabs on to vines and swings from the side of the panel to the centre and returns to starting position.<br>• As Mowgli reaches the centre, the character 'swaps' out the wild to a Spreading wild wild.<br><br>Animation sequence: Second<br>Occurrence: 1 TIME | **Top paying fruit symbol = wild**<br>(if that wild fruit is hit on synced reel/s, all of it's instances will spread) |

FIG. 12A 40 38

| 46 Host Character | 48 Ream Characteristics | 50 1st Reel Feature | 50 2nd Reel Feature | 52 Bonus Reel Combinations |
|---|---|---|---|---|
| Character B: Baloo | 3x3x4x3x3 | **Stacked symbol**<br><br>**Feature effect:**<br>(Chosen at random each spin, this includes wild and treasure chest, stacks shouldn't be very common and should be rather short, 2 up to 5 symbols even less for wilds and chest)<br><br>**Animation Presentation:**<br>Baloo spins 360 a presents the symbol which will be stacked<br><br>*On first instance, the character will not have a symbol in their 'paws' it will appear for the first time after the first symbol appearance<br><br>Assuming that all characters will consist of 3 idle animations **Baloo will carry out 3 idle animations, 1 holding the symbol, 1 neutral, 1 when not holding the symbol. When Baloo appears as a guest and does not carry the "Stacked Symbol" feature, the character will play out 2 idles (with and neutral) when the character does not consist of feature, they will play out 2 idles (without and neutral)<br><br>Animation Sequence: Second<br>Occurrence: Every Spin | **Treasure chest**<br><br>**Feature Effect:**<br>(Present on the longest reels, only R3 in this realm. Can be present on two or three reels in other realms)<br><br>Possible contents:<br>• Coins<br>• Guest join the realm (if none is present)<br>• Guarantee guest to stay for X more rounds (if guest is present)<br><br>**Animation Presentation:**<br>Baloo animates on to screen and shakes the Frame of the panel, causing a Honey Comb (Treasure Chest) to fall on game panel<br><br>Animation Sequence: First<br>Occurrence: 1 Time | **Top paying fruit symbol = wild**<br>(if that wild fruit is hit on synced reel/s, all of it's instances will spread)<br><br>**1 Sticky Respin**<br>(on any win, including treasure chest, pays out and opens the chest only after respin) |

FIG. 12B 40 38

| 46 Host Character | 48 Ream Characteristics | 50 1st Reel Feature | 50 2nd Reel Feature | 52 Bonus Reel Combinations |
|---|---|---|---|---|
| Character C: Shere Khan | 3x3x4x3x3 | **1 Sticky Respin**<br><br>**Feature Effect:**<br>(on any win, including treasure chest, pays out and opens the chest only after respin)<br><br>**Animation Presentation:**<br>Strike with Front Paw<br><br>Animation Sequence: Second<br>Occurrence: Every Win | **Stacked wilds on highest reels**<br><br>**Animation Presentation:**<br>Roar at the reel<br><br>Animation Sequence: First<br>Occurrence: 1 Time | **symbol = wild**<br>(big chances for respin with multiple wilds after respin)<br><br>**Win both ways**<br>(big respin potential and decent chances for multiple 5 OAK both ways wins)<br><br>**Spreading Wilds**<br>(wilds from original spin spread first, then only new wilds on the respin spread but this can still create lots of winning combinations with extra reel height) |

FIG. 12C 38 40

| 46 Host Character | 48 Ream Characteristics | 50 1st Reel Feature | 50 2nd Reel Feature | 52 Bonus Reel Combinations |
|---|---|---|---|---|
| Character D: Kaa | 3x4x4x4x3 | **Win both ways**<br><br>**Animation Presentation:**<br>Kaa animates from one side of the panel to the other and terns to the starting position<br><br>Animation Sequence: First<br>Occurrence: 1 Time | **x3 wild multiplier**<br><br>**Feature Effect:**<br>(only on wins containing wilds)<br><br>**Animation Presentation:**<br>• Wild symbol appear in the centre of the screen<br>• Kaa animated to the centre of the screen and plays a bite animation<br>• A x3 is added to the wild<br><br>Animation Sequence: Second<br>Occurrence: 1 Time | **Top paying fruit symbol = wild**<br>(many extra wilds and all of them pay out x3 both pays)<br><br>**Synced reels**<br>(whole 3x4 block on R2-R4 is synced giving big win potential especially when wild symbol lands on R1 or R5)<br><br>**Treasure chest**<br>(treasure chest on three reels)<br><br>**Spreading Wild**<br>(not more likely to have wild wins multiplied, but more likely to have big wins multiplied when wild is present) |

FIG. 12D

| 46 Host Character | 48 Ream Characteristics | 50 1st Reel Feature | 50 2nd Reel Feature (40, 38) | 52 Bonus Reel Combinations |
|---|---|---|---|---|
| Character E: Bagheera | 4x3x3x3x4 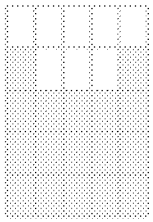 | **Top paying fruit symbol = wild**<br><br>**Feature Effect:**<br>(Top paying fruit only)<br><br>**Animation Presentation:**<br>Bagheera swipes it's tail to present the top paying fruit is now a wild<br><br>Animation Sequence: First<br>Occurrence: 1 Time | **x1, x2, x3 or x5 multiplier**<br><br>**Feature Effect:**<br>(on some wins, including treasure chest coin wins)<br><br>**Animation Presentation:**<br>Bagheera pounces on the top of the panel, and swipes down using their paw to multiply the winning x2 - x5<br><br>Animation Sequence: Second<br>Occurrence: Some Wins | **Spreading Wilds**<br>(top paying wild fruits and regular wilds are present on all reels and they're spreading combined with x2 multiplier on all wins)<br><br>**x3 wild multiplier**<br>(wild multiplier will be active much more often for a total multiplier of x6)<br><br>**Treasure Chest**<br>(can be hit on reel 1 & 5, with all coin wins multiplied x2) |

FIG. 12E

GAMING MACHINE HAVING MULTIPLE REEL FEATURES AND METHODS OF OPERATING SAME

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to gaming machines and more particularly, to an apparatus and method for operating a gaming machine to provide a game having multiple reel features.

BACKGROUND OF THE INVENTION

At least some known gaming systems display reel games that include a plurality of reels with each reel including a plurality of symbols. During game play, known systems accepts a wager from a player, the player selects one or more paylines, the system spins the reels, and sequentially stops each reel to display a combination of symbols on the reels. The system then awards the player an award based on the combination of symbols orientated along the selected payline. At least some known gaming systems include bonus feature games that may include additional free spins and/or progressive awards that are randomly triggering throughout the game play. Because these bonus features are randomly triggered, such features are not available during normal game play, and are used during infrequency bonus feature events, such as, free spins. By limiting the use of these special features to free spins, the ability to provide additional game features and volatility in the expected payouts of the gaming systems are limited.

Overtime, players may become frustrated with known bonus feature games because the bonus feature games are only available during bonus games and have limited player interaction and affect during normal game play. Accordingly, new game programs are necessary to allow game program designed to develop new features that allow more flexibility in award payouts and the number of special features being used during normal game play to appeal to player interest and enhance excitement in order to entice longer play and increased profitability. The present invention is directed to satisfying these needs.

SUMMARY OF THE INVENTION

In one aspect of the present invention, a gaming machine is provided. The gaming machine includes a display device, a user input device, a database, and a controller. The display device is configured to display a game to a player. The user input device is configured to receive an input representative of a wager amount from a player. The database includes a reel feature selection table that includes a plurality of reel feature sets, each reel feature set including at least two different reel features. The controller is configured to initiate a first instance of the game upon receiving a request from the player via the input device, select a first primary reel feature set from the reel feature selection table being stored in the database, and generate a first reel feature combination including the selected first primary reel feature set for use with the first instance of the game. The controller displays the game on the display device including a plurality of reels including a plurality of symbols, and a host character associated with the selected first primary reel feature set. The controller randomly generates an outcome of the first instance of the game including reel features included in the selected first primary reel feature set, displays the outcome on the display device, and provides an award to the player as a function of the outcome.

In another aspect of the present invention, a method of operating a machine is provided. The machine includes a display device, a user input device, and a controller. The method includes the controller performing the steps of initiating a first instance of the game upon receiving a request from the player via the user input device, selecting a first primary reel feature set from a reel feature selection table being stored in a database, and generating a first reel feature combination including the selected first primary reel feature set for use with the first instance of the game. The controller displays the game on the display device including a plurality of reels including a plurality of symbols and a host character associated with the selected first primary reel feature set, randomly generates an outcome of the first instance of the game including reel features included in the selected first primary reel feature set, displays the outcome on the display device, and provides an award to the player as a function of the outcome.

In one embodiment of the present invention, one or more non-transitory computer-readable storage media, having computer-executable instructions embodied thereon are provided. When executed by at least one processor, the computer-executable instructions cause the processor to initiate a first instance of the game upon receiving a request from the player via the input device, select a first primary reel feature set from a reel feature selection table being stored in a database, and generate a first reel feature combination including the selected first primary reel feature set for use with the first instance of the game. The processor displays the game on the display device including a plurality of reels including a plurality of symbols and a host character associated with the selected first primary reel feature set, randomly generates an outcome of the first instance of the game including reel features included in the selected first primary reel feature set, displays the outcome on the display device, and provides an award to the player as a function of the outcome.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 9-12E are illustrations of exemplary database records generated by the system shown in FIG. 1, according to embodiments of the present invention.

Corresponding reference characters indicate corresponding parts throughout the drawings.

DETAILED DESCRIPTION OF THE PREFERRED EMBODIMENT

With reference to the drawings and in operation, the present invention overcomes at least some of the disadvantages of known gaming machines by providing a gaming system that generates and displays a slot-type game to a player that includes a plurality of reel features that may be used during game play. Each reel feature includes a special feature that may increase the probability of the player obtaining an award during game play.

In general, the system generates a slot-type game (shown in FIG. 5) that includes a Fusion Realms™ feature that includes a number of base modes. Each of the base modes includes a number of special reel features. Each base mode has a character or object that represents the mode's set of special reel features. For example, in one embodiment, the system may generate and display a slot-type game having a Jungle Book™ theme with a plurality of game characters. The special reel features are represented by jungle book characters. For example, each character may represent two different reel features. In addition, each base mode may be played as a stand-alone game. For example, in one embodiment, the game may include five base modes, with each base mode including a different character and a different set of special reel features. When the Fusion Realms™ feature is activated, a character from one base mode enters another base mode and brings a number of features with him (e.g., sticky wilds, multipliers, etc.). Now the game is played in a mode with all three features activated (e.g., two reel features from the base mode and one reel feature from the guest character) for a limited amount of spins. For example, in one embodiment, the Fusion Realms™ feature may be triggered at random and the guest character brings one reel feature to add to the base mode reel feature set. By providing a gaming system that uses a plurality of special reel features during each instance of the game, the system generates a large number of reel feature combinations. For example, in one embodiment, the Fusion Realm™ feature may include five base modes and forty different combinations of three-reel feature sets.

Figure 5:
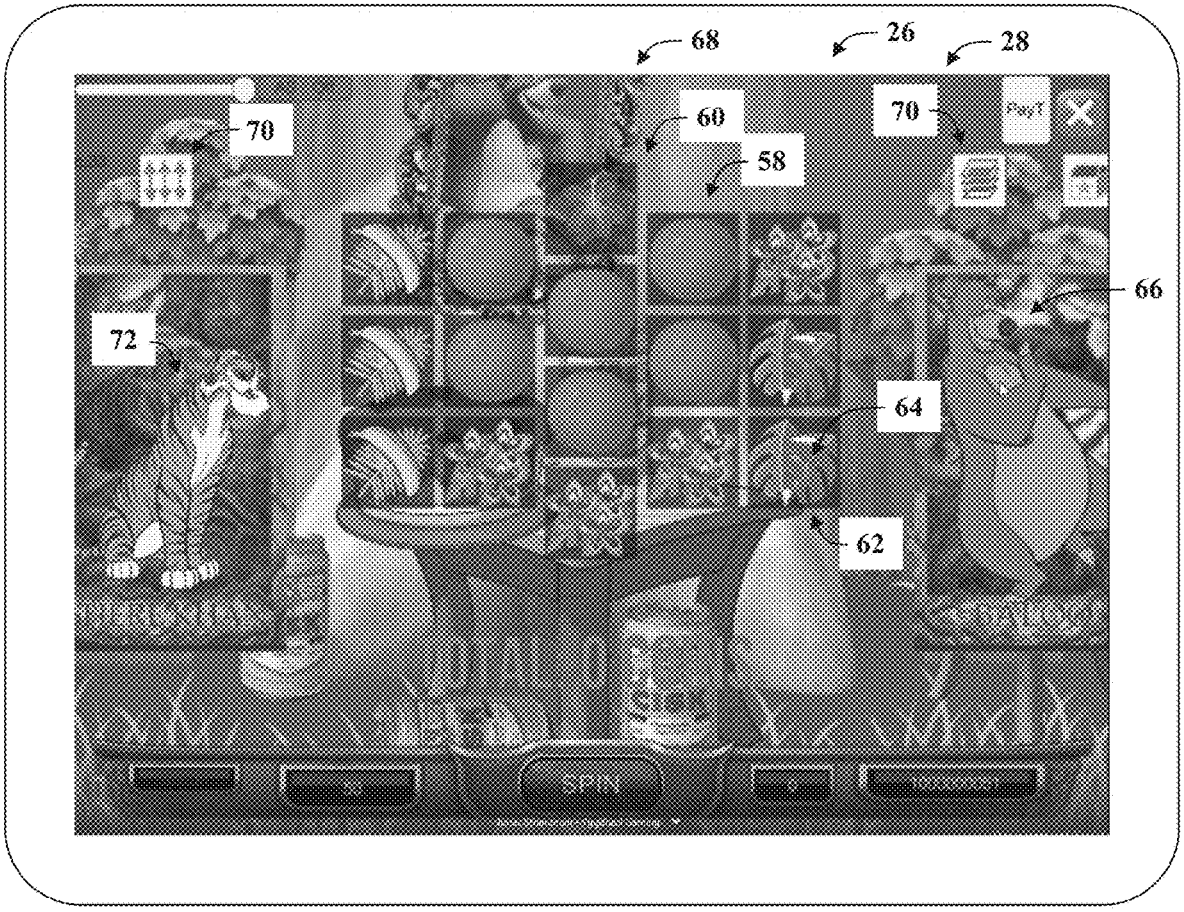
FIG. 5 is a graphical display of a game that may be displayed using the system shown in FIG. 1, according to an embodiment of the present invention.

For example, with reference to FIGS. 5-8B, in one embodiment the system generates a slot-type game that includes five realms with different reel feature sets that are associated with five different characters: Mowgli; Baloo; Share Khan; Kaa; and Bagheera. Each realm has a host (mandatory) character and may have a guest character (optional). The Host character is presented on the right side of the screen (as shown in FIG. 5) with guest on the left side. Each host character holds two special reel features active in his realm and can move to different character's realm (as a guest) with only one randomly picked reel feature. When player starts the game for the 1$^{st}$ time, the system randomly selects a starting realm that includes a host character only, and generates the game including the reel feature set associated with the host character. For example, the system may display an initial game instance with the reel matrix associated with the selected host character and randomly generate an outcome of the initial game instance using the special reel features associated with the host character. The system then spin and stop the reels to display the game outcome and provide an award to the player based on the outcome of the game.

During a subsequent play of the game, when only host character was present in the previous game instance, the system may randomly select one of three reel feature combinations that are based on the special reel feature set associated with the current host character. For example, when only host character was present each spin can result in: 1) the host character stays in his realm (realm stays the same) and the game instance is generated using the reel features associated with the host character; 2) the host character stays in his realm and 1 of 4 guest characters joins (realm stays the same), and the game instance is generated using the reel features associated with the host character and one reel feature associated with the selected guest character; or 3) the host character moves to different realm (1 of 4 when guest is present) as a guest character (game realm is changed to a new one), and the game instance is generated using a reel feature set associated with a selected new host character and one reel feature associated with the previous host character.

When a host character and a guest character are both present in a previous game instance, the system may select the reel features for a subsequent game instance such that the subsequent spin may result in: 1) the host character and the guest character both stay and the game instance is generated using the previous combination of reel features; 2) the guest character leaves (keep playing in host realm) and the game instance is generated using only the reel features associated with the host character; and 3) the host character leaves (move to new realm) and the game instance is generated using the reel features associated with the previous guest character (not the new host character).

In one embodiment, the system may allow the player to change the bet amount only when no guest character is present in the game (meaning, probability of current realm character going to another realm or another character joining as guest should always be the same, no matter how many spins player made with only the host present).

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
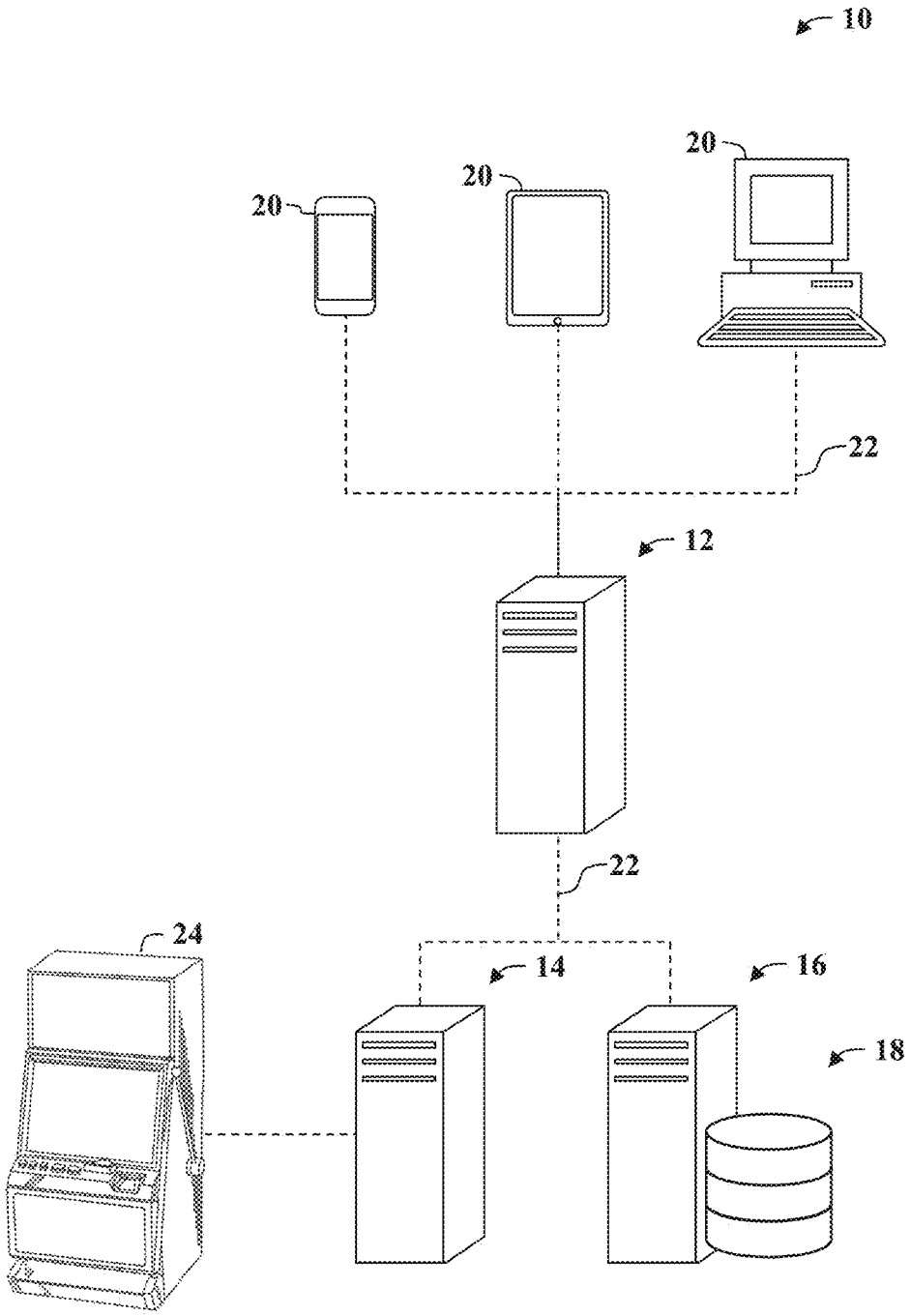
FIG. 1 is a schematic illustrating various aspects of a system, according to an embodiment of the present invention.

Referring to FIG. 1, in the illustrated embodiment, the system 10 includes a website hosting server 12, a gaming server 14, a database server 16, a database 18, and one or more client computing devices 20 that are each coupled in communication via a communications network 22. In one embodiment, the system 10 may also include one or more gaming machines 24 that are coupled to the gaming server 14 via the communications network 22. The communications network 22 may be any suitable connection, including the Internet, file transfer protocol (FTP), an Intranet, LAN, a virtual private network (VPN), cellular networks, etc. . . . , and may utilize any suitable or combination of technologies including, but not limited to wired and wireless connections, always on connections, connections made periodically, and connections made as needed. Each server may include one or more server computers that each include a processing device that includes a processor that is coupled to a memory device. The processing device executes various programs, and thereby controls components of the server according to user instructions received from the client computing devices and/or other servers. The processing device may include memory, e.g., read only memory (ROM) and random access memory (RAM), storing processor-executable instructions and one or more processors that execute the processor-executable instructions. In embodiments where the processing device includes two or more processors, the processors can operate in a parallel or distributed manner. The processing device may also include a memory device for storing programs and information in one or more databases, and retrieving information from the databases that is used by the processor to perform various functions described herein. The memory device may include, but is not limited to, a hard disc drive, an optical disc drive, and/or a flash memory drive. Further, the memory device may be distributed and located at multiple locations.

The client computing device 20 may include any suitable device that includes a display device configured to display websites to the user and a user input device, such as, for example, a keyboard and/or mouse, that enables a user to access and communicate with the system 10 including sending and/or receiving information to and from the system 10 and displaying information received from the system 10 to the user. The client computing device 20 may include a processing device that includes a processor that is coupled to a memory device. The processing device executes various programs, and thereby controls components of the client computing device 20 according to user instructions received via the user input device and/or server computers. For example, in one embodiment, the client computing device 20 may include, but is not limited to, a desktop computer, a laptop or notebook computer, a tablet computer, smartphone/tablet computer hybrid, a personal data assistant, a handheld mobile device including a cellular telephone, and the like. In addition, the client computing device 20 may include a touchscreen that operates as the display device and the user input device. In the illustrated embodiment, the client computing device 20 includes a web-browser program that is stored in the memory device. When executed by the processor of the client computing device, the web-browser program enables the client computing device to receive software code from the website hosting server 12 including, but not limited to HTML, JavaScript, and/or any suitable programming code that enables the client computing device 20 to generate and display a website and/or webpages on the display device of the client computing device.

The website hosting server 12 is programmed to host a website including webpages (shown in FIG. 5) that are accessible by a user via one or more client computing devices 20. The website hosting server 12 executes a website application program that retrieves code from the gaming server 14 and/or the database server 16 and executes the application code to render one or more webpages on a display device of a client computing device 20 in response to requests received from the user via the client computing device 20 to allow users to interact with the website. For example, in one embodiment, the website hosting server 12 may host a gaming website 26 and display a slot-type game 28 (shown in FIG. 5) being generated by the gaming server 14. In one embodiment, the gaming server 14 may generate game code associated with the slot-type game 28 and transmit the game code to the website hosting server 12. The website hosting server 12 may receive the game code from the gaming server 14 and generate rendered HTML code that is transmitted to the client computing device 20 and causes the web-browser program installed on the client computing device 20 to execute the rendered HTML code to display the slot-type game 28 on the client computing device 20. In addition, the website hosting server 12 may receive user requests from the client computing device 20 and transmit the requests to the gaming server 14 to enable the gaming server 14 to generate the game code based on instructions included in the received user requests.

The database server 16 includes a processor and memory device that is connected to the database 18 to retrieve and store information contained in the database 18. In the illustrated embodiment, the database 18 contains information on a variety of matters, such as, for example, software code associated with a game program that may be executable by the gaming server 14 to generate the slot-type game 28. Moreover, the database 18 may include information associated with webpages associated with one or more websites and information associated with the slot-type game including, but not limited to, a game type, a number of game symbols associated with the game, reel matrices, image data for producing game images and/or screens on the client computing device 20 and/or gaming machine 24, symbol indicia, symbol weights, paytables, and/or winning combination tables which represent relationships between combinations of random numbers, combinations of symbol matches and types of awards.

For example, in one embodiment, the database 18 may contain a reel feature data table 30 (shown in FIG. 9) that includes information associated with special reel features that may be used with the slot-type game 28 The reel feature data table 30 includes a plurality of feature records 32 that include information associated with a corresponding reel feature. Each reel feature record 32 is associated with a reel feature and includes a unique reel feature ID 34 and reel feature data 36 that includes computer code associated with the reel feature that enables the gaming server 14 to generate and execute the slot-type game 28 including the corresponding reel feature.

The database 18 may also include one or more reel feature selection tables 38 (shown in FIGS. 10 and 12A-12E). Each reel feature selection table 38 includes a plurality of reel feature set records 40 that may be used by the gaming server 14 for generating the slot-type game 28. Each reel feature set record 40 includes information associated with a set of reel features that corresponding to a host character being displayed in the slot-type game 28. In the illustrated embodiment, each reel feature set record 40 includes a unique reel feature set ID 42, a corresponding selection probability data 44, a host character data 46, reel matrix data 48, host reel feature set data 50, and guest bonus reel feature data 52. The information included in each reel feature set record 40 includes computer code and data that may be used by the gaming server 14 to generate and execute the game 28. For example, the host character data 46 includes information associated with a host character and/or host realm that is displayed during the game 28. The reel matrix data 48 includes information that may be used by the gaming server 14 to generate a reel matrix and/or reels for use during the slot-type game 28. The host reel feature set data 50 includes information associated with the set of reel features that correspond to the host character. For example, the host reel feature set data 50 may include unique reel feature IDs 34 that may be used to identify and retrieve corresponding reel feature records 32 being stored in the reel feature data table 30. The guest bonus reel feature data 52 includes information associated with the one or more reel features that are associated with the corresponding reel feature set. For example, in one embodiment, the guest bonus reel feature data 52 include unique reel feature IDs 34 that may be used to identify and retrieve corresponding reel feature records 32.

The database 18 may also include a feature combination selection table 54 (shown in FIG. 11) that may be used by the gaming server 14 to generate and execute the game 28. For example, the gaming server 14 may use feature combination selection table 54 to select a combination of reel features for use in generating an outcome of the game 28. In the illustrated embodiment, the feature combination selection table 54 includes a plurality of combination selection records 56. Each combination selection record 56 is associated with a unique group of reel features and includes a unique combination ID, and information associated with a corresponding feature combination including, but not limited to, a number and type of reel features included in the corresponding feature combination, and a selection probability associated with the feature combination. In one embodiment, each combination selection record 56 may be associate with a previous game outcome. For example, as shown in FIG. 11, the feature combination selection table 54 includes a first set of combination selection records 56 that are associated with a previous game outcome that includes host character reel feature sets only, and a second set of combination selection records 56 that are associated with a previous game outcome that includes a host reel feature set and a bonus feature set. Each combination selection record 56 includes information associated with combinations of host reel feature sets and guest bonus reel features.

The gaming server 14 is programmed to execute a game program to generate and display the game 28. Referring to FIG. 5, in the illustrated embodiment, the gaming server 14 is configured to generate and display the slot-type game 28 a plurality of reels 58 being display in a reel matrix 60. The reel matrix 60 includes a plurality of cells 62 arranged in a plurality of rows and a plurality of columns. Each reel 5 is associated with a column being displayed in the reel matrix 60 and includes a plurality of game symbols 64 that are used to display the outcome of the game 28.

The gaming server 14 may generate the game 28 including a reel matrix 60 that displays a different number of cells 62 with one or more of the reels 58. For example, as shown in FIG. 5, in one embodiment, the gaming server 14 may display the game 28 including 5 reels being displayed in the reel matrix 60 including a 3×3×4×3×3 cell arrangement that includes four reels 58 being displayed in columns that include 3 cells 62, and 1 center reel being displayed in a column that includes 4 cells 62. In addition, as show in FIG. 7A, the gaming server 14 may display the game 28 including 5 reels being displayed in a different reel matrix 60 that includes a 3×4×4×4×3 cell arrangement with 2 outer reels 58 being displayed in columns that include 3 cells 62, and 3inner reels 58 being displayed in columns that include 4 cells 62. In one embodiment, the gaming server 14 may display the game 28 included any number of cells 62 that may be displayed in any suitable reel matrix arrangement. In addition, the gaming server 14 may display a different reel matrix 60 with one or more host characters 66.

In the illustrated embodiment, the gaming server 14 displays the game 28 including one or more paylines that are used to indicated winning combinations of game symbols 64 to the players. The paylines may include horizontal paylines, vertical paylines, diagonal pay-lines, and/or any suitable combination of cells 62 that may be used to determine combinations of game symbols 64. For example, during operation, the gaming server 14 is programmed to receive a signal from the player via a client computing device that is indicative of a player's selection to initiate a gaming session including a wager amount, and a selection of one or more paylines associated with a predefined set of cells 62 within the reel matrix 60. The gaming server 14 randomly generates an outcome of the game 28, and generates images of the reels to rotate, and/or spin each reel 5 to initiate a game play, and stop each reel 5 to display a plurality of game symbols 64 associated with the randomly generated outcome. The gaming server 14 determines if the combination of game symbols 64 being displayed with the selected paylines is a winning combination and determines an award to be provided to the player based on a paytable and the wager. Many variations to the above described general play of a slot game fall within the scope of the present invention.

In the illustrated embodiment, the gaming server 14 is programmed to display the game 28 including a plurality of gaming realms 68 that are each associated with a host character 66. Each host character 66 is associated with one or more special reel features that may be used to modify normal game play and provide a special advantage to the player. The gaming server 14 may be programmed to display a reel feature symbol 70 with each host character 66 to indicate the special reel features associated with the displayed host character 66. In the illustrated embodiment, the gaming server 14 may also be configured to select a guest character 72 that includes a bonus reel feature that may also be used to enhance game play. The gaming server 14 may display the guest character 72 with an associated bonus reel feature symbol 70 to indicate the reel feature being used as the bonus reel feature. In the illustrated embodiment, the gaming server 14 is configured to generate an outcome of an instance of the game 28 using the reel features associated with the host character 66 and/or the guest character 72.

Figure 2:
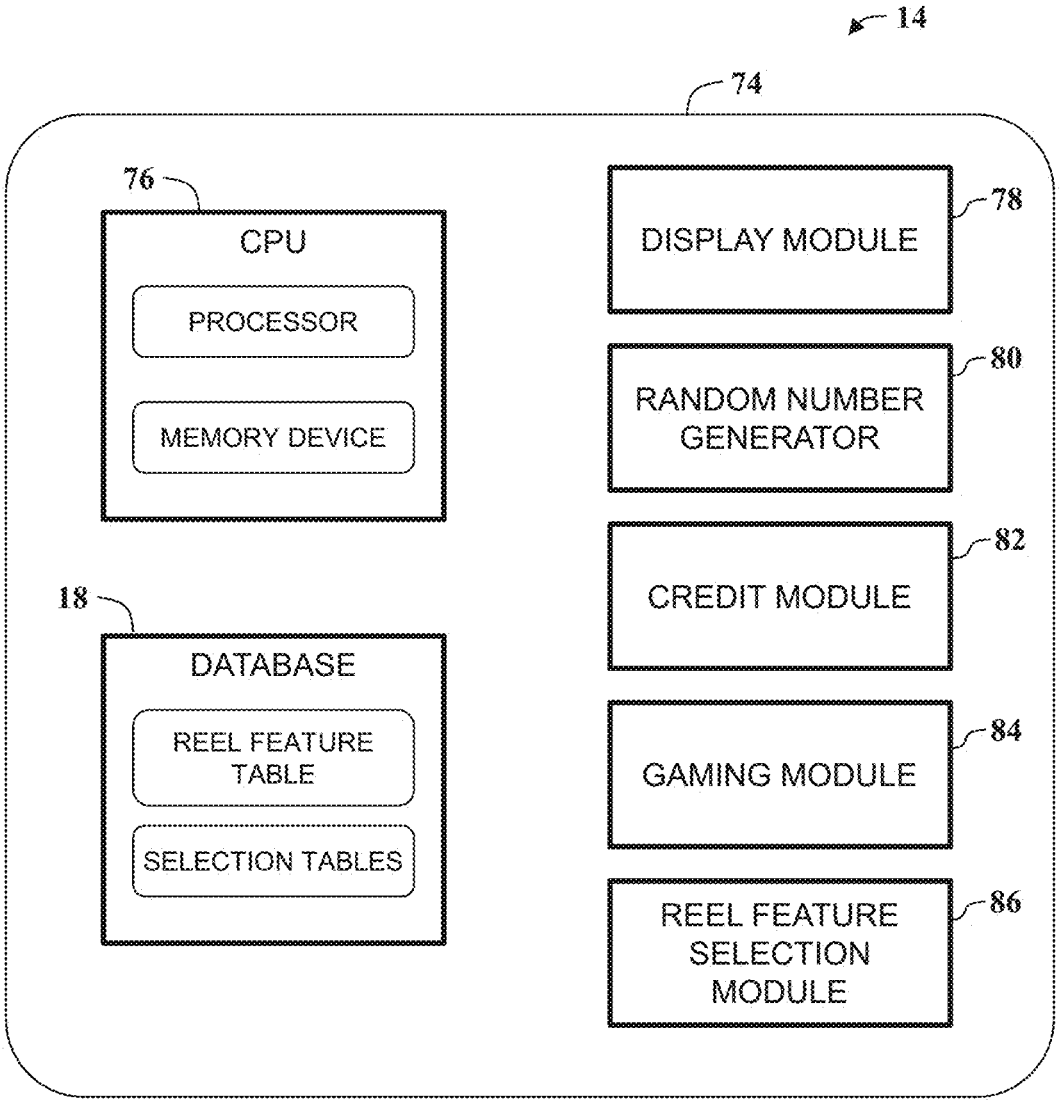
FIG. 2 is a schematic illustrating example components of a gaming controller that may be used with the system shown in FIG. 1, according to an embodiment of the present invention.

Referring to FIG. 2, in the illustrated embodiment, the gaming server 14 includes a gaming controller 74 that includes a central processing unit (CPU) 76 that include a processor coupled to a memory device, a credit module 78, a random-number generator 80, a display module 82, a gaming module 84, and a reel feature selection module 86. The CPU 76 includes a processor that is coupled to a memory device. The memory device includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor to store, retrieve, and/or execute instructions and/or data. The memory device stores programs and databases used by the processor. The CPU 76 executes various programs, and thereby controls other components of the gaming controller 74 according to player instructions and data accepted by the client computing device 20 and/or gaming machine 24.

The credit module 78 manages the amount of player's credits which may be used to place wagers on the game 28.

The credit module 78 may establish and manage a credit balance associated with the player that includes information associated with a number of credits that may be available to place wagers associated with the game 28.

The display module 82 generates computer code that may be used to generate and display various images on screens preferably by using computer graphics and image data stored in the database 18 on the client computing device 20 and/or gaming machine 24.

The gaming module 84 executes a game program, and thereby conducts a game in accordance with the embodiments described herein. Moreover, the gaming module 84 stores and retrieves information in the database 18 including, but not limited to, a game type, game data, reel feature records 32, feature set records 40, combination selection records 56, image data for producing game images and/or screens being displayed with the game 28, and temporarily stores variables, parameters, and the like that are used by the CPU 76. In addition, the gaming module 84 retrieves and stores indicia, symbol weights, paytables, and/or winning combination tables which represent relationships between combinations of random numbers, combinations of symbol matches and types of awards in the database 18.

The gaming module 84 receives a player selection input from the client computing device 20 and/or gaming machine 24 and selects game symbols based on the player's selection. The gaming module 84 executes the game program using random numbers to determine the symbols being displayed during an outcome of the game 28 and/or to determine an amount of award to the provided to the player. For example, the RNG 80 generates and outputs random numbers to the gaming module 84 preferably at the start of each round of a game. The gaming module 84 uses the random numbers provided by the RNG 80 to randomly select an arrangement of symbols to be displayed on the reels. Moreover, the gaming module 84 generally uses random numbers generated by the RNG 80 to play the games and to determine whether or not to provide an award to a player. The gaming module 84 may also receive combinations of random numbers from the RNG 80 and compare the generated combinations with winning combinations stored in the winning combination table to determine if the generated outcome is a winning outcome that is associated with a type of award. In general, the term "award" may be a payout, in terms of credits or money. However, it should be noted that the term award may also refer to other types of awards, including, in-game award, such as bonus features, free games, and/or free spins.

The reel feature selection module 86 is configured to select reel features that are used during the game 28, and transmit data associated with the selected reel features to the gaming module 84 for use in generating a round of the game 28. For example, in one embodiment, the reel feature selection module 86 receives a signal indicating a request to initiate an instance of the game 28. Upon receiving the request, the reel feature selection module 86 is configured to access the reel feature selection table 38 and selects a feature set record 40. The reel feature selection module 86 determines the reel feature set that is associated with the selected feature set record 40 and identifies the reel features that are included in the selected reel feature set. For example, the reel feature selection module 86 may be configured to access the host reel feature set data 50 included in the selected feature set record 40 and identify the unique reel feature IDs 34 included host reel feature set data 50. The reel feature selection module 86 may then access the reel feature data table 30 and retrieve the reel feature records 32 that corresponding to the identify the unique reel feature IDs 34. The reel feature selection module 86 may then transmit the data included in the retrieved the reel feature records 32 to the gaming module 84 for use in generating and executing the game 28.

For example, in the illustrated embodiment, the gaming controller 74 is configured to initiate a first instance of the game upon receiving a request from the player and select a first primary reel feature set from the reel feature selection table 38 being stored in the database 18. The gaming controller 74 then generates a first reel feature combination including the selected first primary reel feature set for use with the first instance of the game 28. The gaming controller 74 displays the game 28 including a host character associated with the selected first primary reel feature set and a plurality of reels 58 being displayed in a reel matrix 60 associated with the host character 66. The gaming controller 74 randomly generates an outcome of the first instance of the game including reel features included in the selected first primary reel feature set, and spins and stops the reels 58 to display the outcome and provide an award to the player as a function of the outcome. In one embodiment, the gaming controller 74 is configured to randomly select a first primary reel feature set from the reel feature selection table 38 using a random number received from the RNG 80 and the selection probability data 44 associated with each feature set record 40. In another embodiment, the gaming controller 74 may display one or more selection screens (not shown) that includes one or more host characters 66 including the corresponding reel matrix 60. The gaming controller 74 allows the player to select an initial host character 66 and corresponding realm 68 via the selection screens and initiates the first instance of the game using the player selected host character 66 and/or realm 68. In one embodiment, the gaming controller 74 may allow the player to select the initial host character 66 and/or realm 68 to be used during the first instance of the game, and randomly select the first reel feature combination to be used with the first instance of the game which may include, for example, the reel feature set associated with the host character only, or the reel feature set associated with the host character and a bonus reel feature associated with a guest character.

In one embodiment, the reel feature selection module 86 is configured to retrieve the host character data 46 and the reel matrix data 48 from the selected feature set record 40 and transmit the data to the gaming module 84. Upon receiving the host character data 46 and the reel matrix data 48, the gaming module generates the instance of the game 28 include generating computer code used to display the game 28 with a character realm 68 including the host character 66 and reel matrix 60 associated with the selected feature set record 40. In addition, the gaming module 84 may also display the reel feature symbols 70 that corresponding to the reel features included in the reel feature set. For example, in one embodiment, when generating an instance of the game 28, the gaming controller 74 may determine a reel matrix associated with the selected first primary reel feature set, and display the outcome of the first instance of the game with the reel matrix associated with the selected first primary reel feature set.

In one embodiment, the reel feature selection module 86 may also access the guest bonus reel feature data 52 included in the selected feature set record 40 to determine a guest reel feature that may be used in generating the game 28. For example, the reel feature selection module 86 may identify the unique reel feature ID 34 included in the guest bonus reel feature data 52, retrieve the corresponding reel feature record 32, and transmit the retrieved reel feature record 32 to the gaming module 84 for use in generating the game 28. The reel feature selection module 86 may also identify and retrieve the character data 46 that is associated with the guest bonus reel feature data 52 and transmit the character data to the gaming module 84 for use in displaying the guest character 72 in the host character realm 68. For example, when generating the first instance of the game 28, the gaming controller 74 may access the reel feature selection table and select a first bonus reel feature associated with the selected first primary reel feature set, and generate the outcome of the first instance of the game including the first primary reel feature set and the selected first bonus reel feature set.

In one embodiment, upon selecting the first primary reel feature set, the reel feature selection module 86 may generate the feature combination selection table 54 to include plurality of feature groups associated with the first reel feature combination. The reel feature selection module 86 may then use the generated feature combination selection table 54 to randomly select one of the plurality of feature groups to generate a second reel feature combination for use in subsequent instances of the game 28. For example, in one embodiment, the reel feature selection module 86 may generate the feature combination selection table 54 to include a first group of combination selection record 56 that may be selected when the previous game instance included a host character reel feature set only, and a second group of combination selection record 56 that may be selected when the previous game instances included a host character reel feature set and a guest character reel feature set. Each combination selection record 56 includes information associated with combinations of reel feature sets and bonus reel features. In one embodiment, the gaming controller 74 may access the feature combination selection table 54 for each subsequent instance of the game 28 after the initial game instance has been generated. For example, in one embodiment, only certain guest bonus reel features may be used with a host character reel feature set. After randomly selecting the host character for use in the first instance of the game 28, the reel feature selection module 86 may generate the feature combination selection table 54 using the corresponding guest reel features included in the reel feature selection table 38.

During the game 28, the gaming controller 74 may initiate a second instance of the game 28 upon receiving another request from the player or with a free spin. Upon initiating a subsequent instance of the game 28, the gaming controller 74 generates a second reel feature combination as a function of the first reel feature combination, and generates an outcome of the second instance of the game using the second reel feature combination. The gaming controller 74 may access the reel feature selection table and select a bonus reel feature that is associated with the first primary reel feature set and generate the second reel feature combination including the first primary reel feature set and the selected bonus reel feature. For example, the gaming controller 74 may determine select a guest character that may be associated with the host character, and generate the instance of the game using the set of reel features associated with the host character 66 and one of the reel features associated with the guest character 72 (as shown in FIG. 5).

Figure 8A:
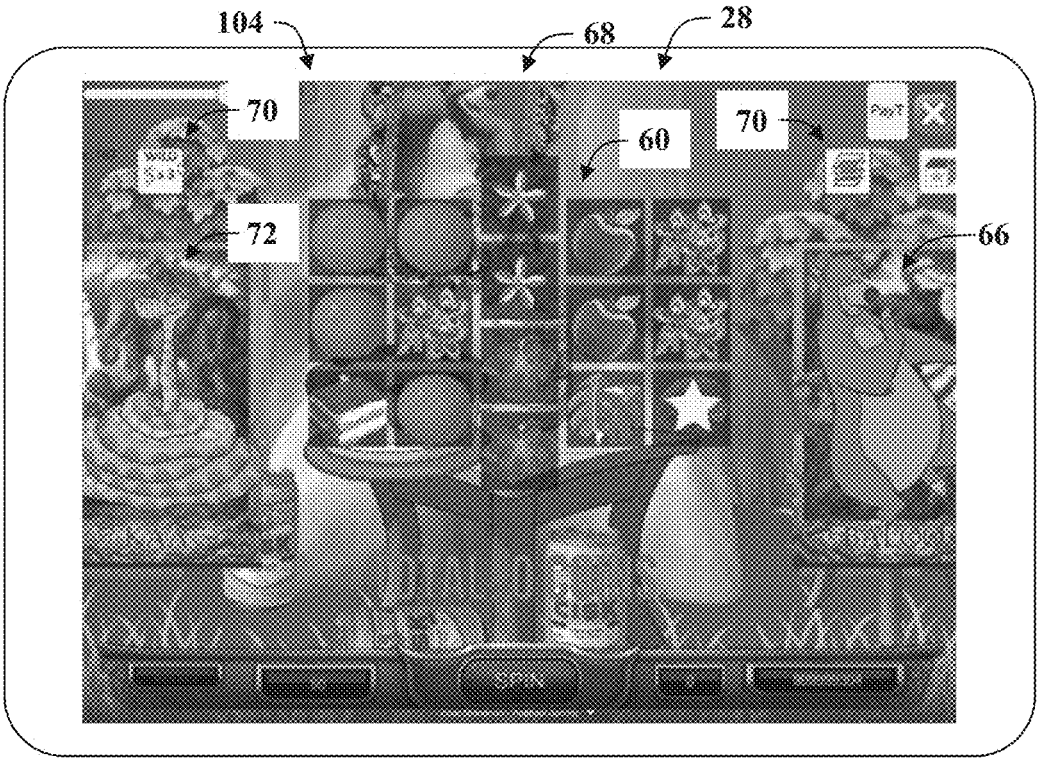
FIGS. 8A-8B illustrate another sequence of graphical displays of the game show in FIG. 6, according to an embodiment of the present invention.
Figure 8B:
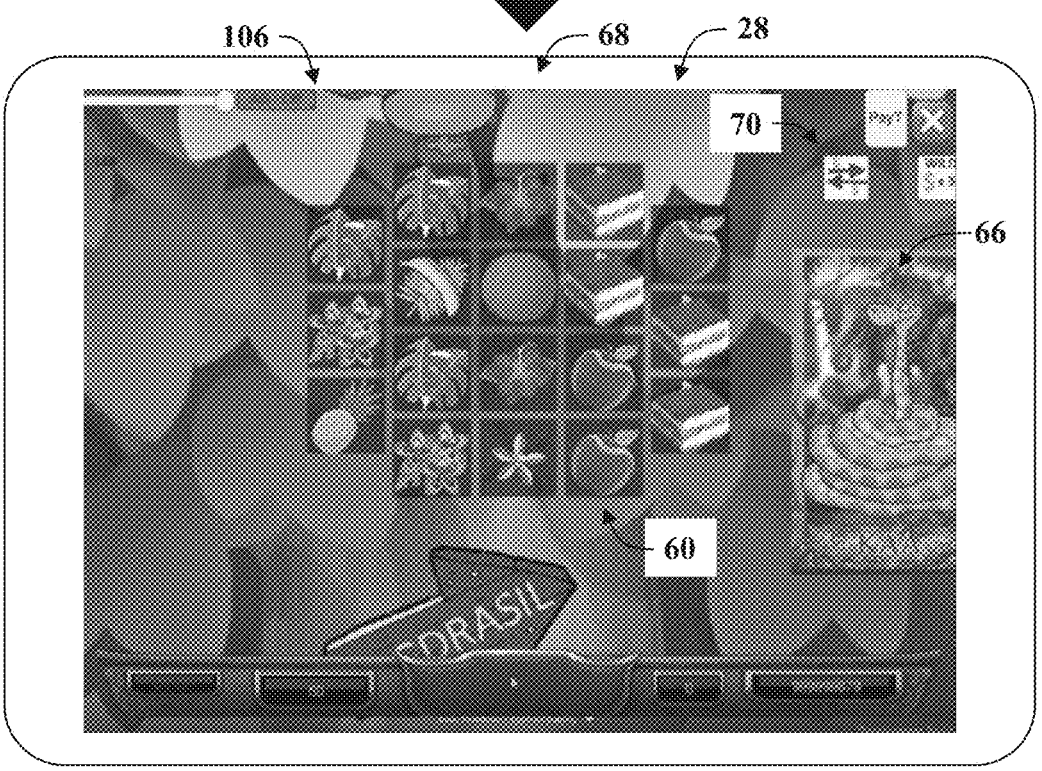

In one embodiment, the gaming controller 74 may also be configured to generate the second reel feature combination including only the first primary reel feature set previously used during the first game instance upon determining that the first reel feature combination includes the first primary reel feature set and a bonus reel feature. For example, the gaming controller 74 may remain in the realm of the host character 66 and initiate the second instance of the game 28 with the reel features associated with host character 66 only (as shown in FIGS. 8A-8B).

In one embodiment, the gaming controller 74 may be configured to select a bonus reel feature from the first primary reel feature set, access the reel feature selection table, and select a second primary reel feature set associated with the selected bonus reel feature. The gaming controller 74 may then generate the second reel feature combination including the selected second primary reel feature set and the selected bonus feature for use during the second instance of the game 28. For example, the gaming controller 74 may move the player to the realm of the guest character 72, such that the guest character 72 is now the host character 66 (as shown in FIGS. 8A-8B). The gaming controller 74 then initiates the second instance of the game 28 using the reel feature set associated with previous guest character 72. For example, the gaming controller 74 may determine that the first reel feature combination used during the first instance of the game included a first primary reel feature set from the host character 66 and a bonus reel feature from a guest character 72. The gaming controller 74 may then access the reel feature selection table and select a second primary reel feature set associated with the bonus reel feature, such as a feature set record 40 that includes the bonus reel feature in the host reel feature set data 50, and generate the second reel feature combination including only the second primary reel feature set.

In the illustrated embodiment, the gaming module 84 is configured to execute the code included in the received reel feature records 32 to generate instances of the game with enhanced reel features that improve the probability of obtaining a winning combination and award. For example, as shown in FIG. 9, in one embodiment, the reel feature data table 30 may include information associated with a plurality of reel features including Synced Reels feature, Spreading Wilds feature, Stacked Symbol feature, Treasure Chest feature, 1 Sticky Respin feature, Staked Wilds on Highest Reels feature, Win Both Ways feature, ×3 Wild Multiplier feature, Top Paying Symbol=Wild feature, and ×1 ×2 ×3, or ×5 Multiplier feature.

With reference to FIGS. 9 and 12A-12E, in one embodiment, the feature record 32 associated with Synced Reels feature includes computer instructions that cause the gaming controller 74 to select adjacent reels having the same number of cells 62 and synchronize a rotation of the reels such that the reels display the same symbols in the same position. In addition, the gaming controller 74 may display an animation of a game character 66 grabbing on to vines and pulls down which wrap tightly around the selected reels which will be synced with one another.

The feature record 32 associated with Spreading Wilds feature may include instructions that cause the gaming controller 74 to display a wild symbol on one of the reels being displayed and expand the wild symbol to adjacent cells 62 if the wild symbol is displayed with the reels stopped. For example, the gaming controller 74 may display the wild symbol only on the R3 in this mode and spreading the wild symbol to 1 or 2 more positions.

The feature record 32 associated with the Stacked symbol reel feature may include instructions that cause the gaming controller 74 to randomly select a game symbol at each spin, which may include wild and treasure chest symbols, and display a reel including a stack of the selected symbol. The stacks of symbols may include 2 up to 5 symbols. In addition, the gaming controller 74 may animate a game character 66 to spin a presents the symbol which will be stacked. For example, on a first instance, the character will not have a symbol in their 'paws' and it will appear for the first time after the first symbol appearance.

The feature record 32 associated with the Treasure Chest feature may include instructions that cause the gaming controller 74 to present a special treasure chest symbol on the longest reels, and provide a special award if the treasure chest symbol appears in the outcome such as, for example, coins, having a bonus reel feature join the realm, and/or guarantee the bonus reel feature to stay for a predefined number of game rounds.

The feature record 32 associated with the 1 Sticky Respin feature may include instructions that cause the gaming controller 74 to select a symbol being displayed during a game outcome and hold the selected symbol in place during a subsequent spin. The feature record 32 associated with Stacked wilds feature on highest reels may include instructions that cause the gaming controller 74 to display a reel having a stack of wild symbols.

The feature record 32 associated with Win both ways feature may include instructions that cause the gaming controller 74 to evaluate a combination of symbols in two directions along the same payline such as, for example a combination arranged right to left, and a combination of symbols arranged left-to-right. The feature record 32 associated with the ×3 Wild Multiplier feature may include instructions that cause the gaming controller 74 to multiple any winning combination including a wild symbol by a 3× multiplier.

The feature record 32 associated with the Top paying fruit symbol=wild feature may include instructions that cause the gaming controller 74 to select the top paying symbol being displayed along a payline, and change the top paying symbol to a wild symbol for use in determining a winning combination. The gaming controller 74 may also animate the character to swipes its tail to present the top paying fruit that is now a wild. The feature record 32 associated with the ×1, ×2, ×3, or ×5 Multiplier ×3 Wild Multiplier feature may include instructions that cause the gaming controller 74 to select a multiplier and multiply an award by the selected multiplier value.

Figure 3:
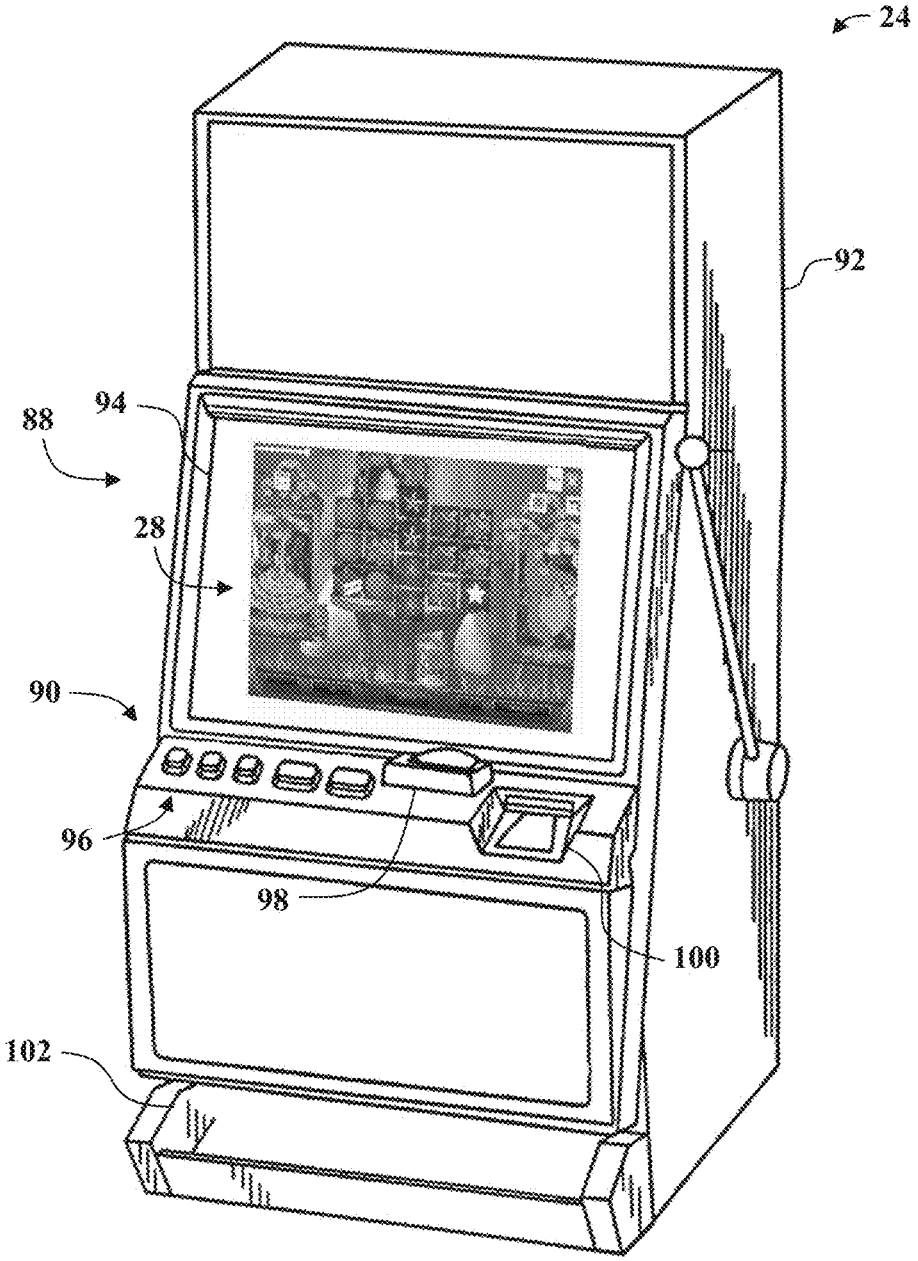
FIG. 3 is a perspective view of an exemplary gaming machine, according to an embodiment of the present invention.

In one embodiment, the gaming controller 74 may be included in a stand-alone or networked gaming machine 24. For example, in reference to FIG. 3, the gaming machine 24 may include a video gaming machine preferably installed in a casino. In the illustrated embodiment, the gaming machine 24 includes a display device 88 for displaying a plurality of games, a user input device 90 to enable a player to interface with the gaming machine 24, and the gaming controller 74 that is operatively coupled to the display device 88 and the user input device 90 to enable a player to play games displayed on the display device 88. The gaming machine 24 also includes a cabinet assembly 92 that is configured to support the display device 88, the user input device 90, and/or the gaming controller 74 from a supporting surface.

The display device 88 and the user input device 90 are coupled to the cabinet assembly 92 and are accessible by the player. In one embodiment, the gaming controller 74 is positioned within the cabinet assembly 92. Alternatively, the gaming controller 74 may be separated from the cabinet assembly 92, and connected to components of the gaming machine 24 through a network such as, for example, a local area network (LAN), a wide area network (WAN), dial-in-connections, cable modems, wireless modems, and/or special high-speed Integrated Services Digital Network (ISDN) lines.

In the illustrated embodiment, the display device 88 includes a display 94 including a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 88 and as the user input device 90. In the illustrated embodiment, the display device 88 displays a game screen (shown in FIG. 5) including indicia and/or symbols for use in a game, e.g., symbols for a keno game, cards used by a card game, roulette wheel and symbols used in a roulette game, and reels used in a reel game. The game screen may include any type of game including, but not limited to, a video keno game, a video slot game, a blackjack game, a video poker game, or any type of game which allows a player to make a wager, play a game, and potentially provide the player an award based on an outcome of the game and a paytable. In addition, the display device 88 may display game play instructions for performing the game including, but not limited to, playing instructions, paytables, paylines, betting lines and/or any other information to enable the gaming machine 24 to function as described herein. Moreover, in one embodiment, the display device 88 may include a plurality of displays 94 that each are be configured to display at least a portion of the game screen and/or game play instructions.

The user input device 90 includes a plurality of input buttons 96, a coin slot 98, a bill acceptor 100, and a coin tray 102 for dispensing coins to the player. In one embodiment, the input buttons 96 include a plurality of BET switches for inputting a wager on a game and initiating an instance of the game during a gaming session, a plurality of selection switches for allowing a player to select a paylines, and a PAYOUT switch for ending a gaming session and dispensing accumulated gaming credits to the player.

The coin slot 98 includes an opening that is configured to receive coins and/or tokens deposited by the player into the gaming machine 24. The gaming machine 24 converts a value of the coins and/or tokens to a corresponding amount of gaming credits that are used by the player to wager on games played on the gaming machine 24. The bill acceptor 100 includes an input and output device that is configured to accept a bill, a ticket, and/or a cash card into the gaming machine 24 to enable an amount of gaming credits associated with a monetary value of the bills, ticket, and/or cash card to be credited to the gaming machine 24. The gaming controller 74 establishes a credit balance included the amount of gaming credits that may be used to place wagers on the game. Upon receiving a request to place a wager by the player via the user input device, the gaming controller 74 adjusts the credit balance based on the wager amount initiates a round of the game. Upon determining the outcome of the game, the gaming controller 74 provides an award to the player based on the outcome, and adjusts the credit balance to reflect the award, if any.

The gaming controller 74 may be configured to manage the amount of player's credits, which is equivalent to the amount of coins and bills counted and validated by the bill acceptor 100, monitor player selections received through the input buttons 96, and accepts various instructions and data that a player enters through the input buttons 96. The gaming controller 74 converts a player's credits to coins, bills, or other monetary data by using the coin tray 102 and/or for use in dispensing a credit voucher via the bill acceptor 100.

Figure 4:
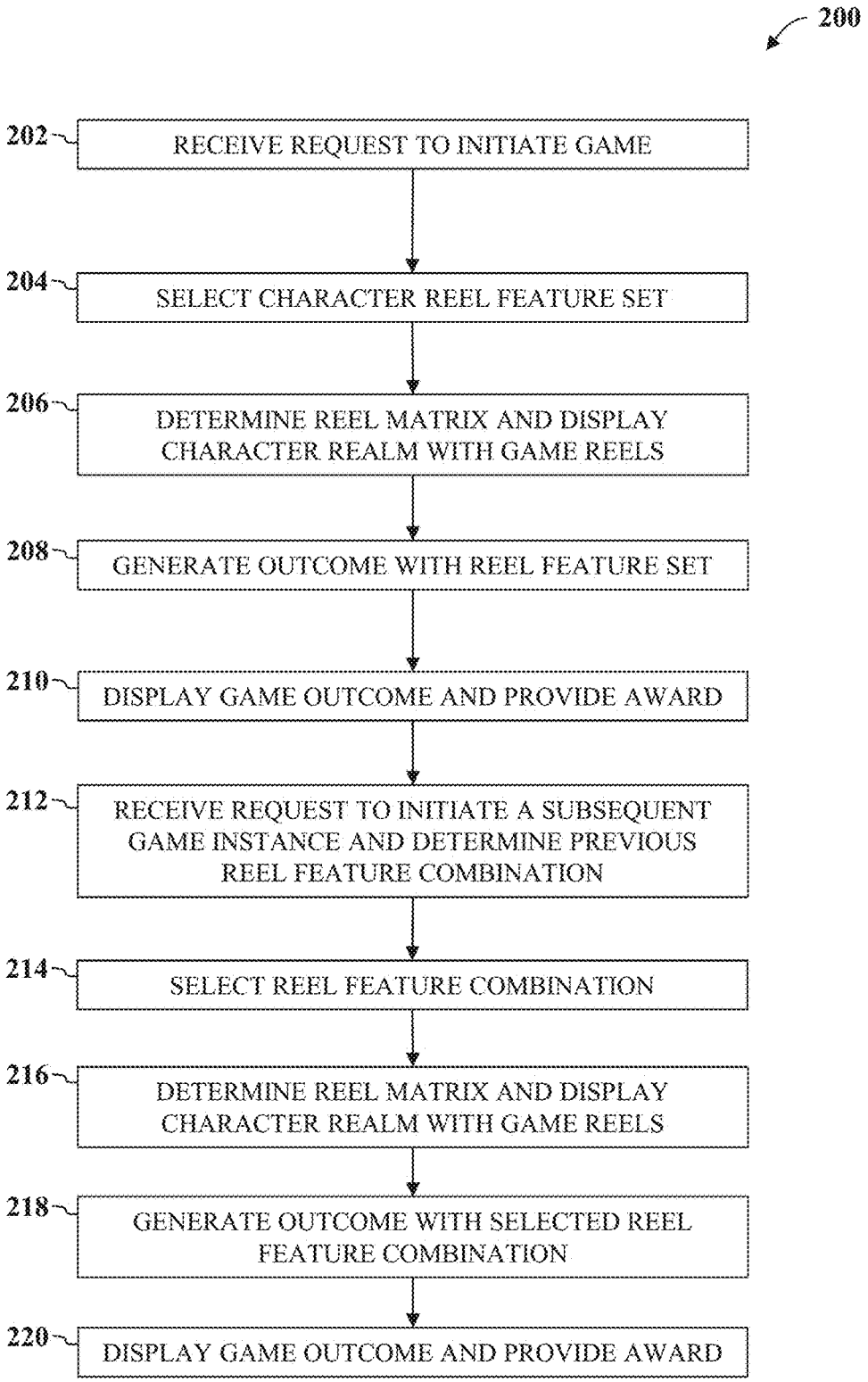
FIG. 4 is a flowchart of a method of operating the system to provide a game to a player, according to an embodiment of the present invention.

FIG. 4 is a flowchart of method 200 that may be used to operate the system to provide a slot-type game to the player. The method 200 include a plurality of steps. Each method step may be performed independently of, or in combination with, other method steps. Portions of the methods may be performed by any one of, or any combination of, the components of the system 10. FIGS. 5-8B are an exemplary entertaining graphical display of the slot-type game 28 that may be generated by the system 10.

Referring to FIG. 4, in the illustrated embodiment, in method step 202, the gaming controller 74 receives a request to initiate the game 28. For example, in one embodiment, the gaming controller may receive a signal indicative of a wager being received by a gaming machine 24 or a URL being received from a client computing device 20 via the website hosting server 12.

In method step 204, the gaming controller 74 accesses the reel feature selection table 38 and selects a host reel feature set record 40. In one embodiment, the gaming controller 74 randomly selects a first primary reel feature set from the reel feature selection table 38 using a random number received from the RNG 80 and the selection probability data 44 associated with each feature set record 40. In another embodiment, the gaming controller 74 displays one or more selection screens that includes one or more host characters 66 and allows the player to select an initial host character 66 and corresponding realm 68 via the selection screens.

In method step 206, the gaming controller 74 accesses the host character data 46, the reel matrix data 48, and the reel feature set data 50 included in the selected host reel feature set record 40 and generates the game 28 including the host character 66, the realm associated with the host character 66, and the reel matrix 60 associated with the host character 66. For example, referring to FIG. 5, in one embodiment, the gaming controller 74 may randomly select the host reel feature set record 40 associated with Character B and display the first instance of the game with the host character 66 having the stacked symbol reel feature and the treasure chest reel feature indicated by the reel feature symbols 70. In addition, the gaming controller 74 may display the reels in the 3×3×4×3×3 reel matrix associated with the host character 66, Character B.

In method step 208, the gaming controller 74 randomly generates an outcome of the first instance of the game 28 using the reel features included in the reel feature set associated with the host character 66.

In method step 210, the gaming controller 74 displays the outcome of the first instance of the game 28 by spinning and stopping the reels to display the game outcome.

In method step 212, the gaming controller 74 receives a request from the player to initiate a second instance of the game and determines the first reel feature combination that was used in the previous game instance.

In method step 214, the gaming controller 74 selects a second reel feature combination for use during the second instance of the game as a function of the first reel feature combination. For example, in one embodiment, the gaming controller 74 may access the feature combination selection table 54 and determine a group of feature combinations based on the first reel feature combination. For example, as shown in FIG. 10, if the first reel feature combination included only a host reel feature set, the gaming controller 74 may select a combination selection record 56 for the second reel feature combination from a group of combinations that include 1) the host reel feature set only, 2) the host reel feature set and a guest bonus reel feature set; and 3) a new host reel feature set and one guest bonus reel feature that is selected from the previous host reel feature set. In addition, if the first reel feature combination includes a host reel feature set and a guest bonus reel feature (as shown in FIG. 10), the gaming controller 74 may select a combination selection record 56 for the second reel feature combination from a group of combinations that include 1) the current reel feature combination including the current host reel feature set and the current guest bonus reel feature; 2) the current host reel feature set only; 3) and a new host reel feature set that is associated with the current guest bonus reel feature set. As shown in FIG. 10, each combination selection record 56 may include selection probability that may be used allow the gaming controller 74 to randomly select one of the combination selection records 56 for use in generating the second reel feature combination.

In method step 216, upon selecting the second reel feature combination, the gaming controller 74 determines the host reel feature set being included in the second reel feature combination, selects the reel feature set record 40 associated with the host reel feature set and determines the reel matrix 60 and the realm 68 associated with the determined host reel feature set. The gaming controller 74 then displays the game 28 including the determined realm 68, reel matrix 60, and associated characters.

Figure 6A:
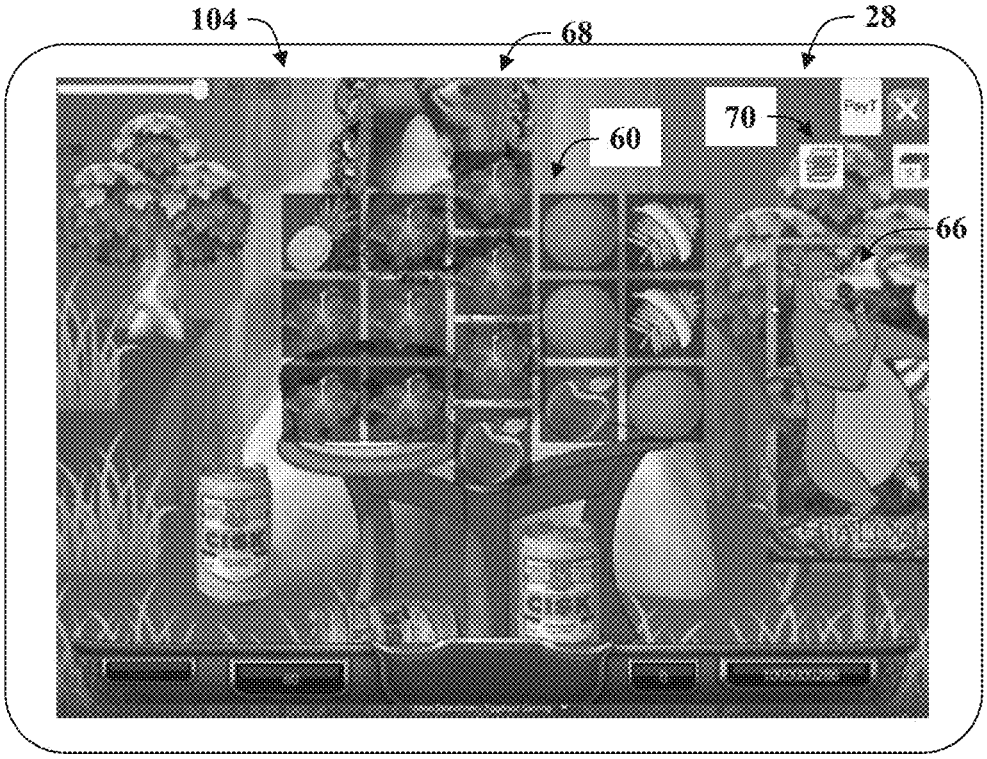
FIGS. 6A-6B illustrate a sequence of graphical displays of the game show in FIG. 6, according to an embodiment of the present invention.
Figure 6B:
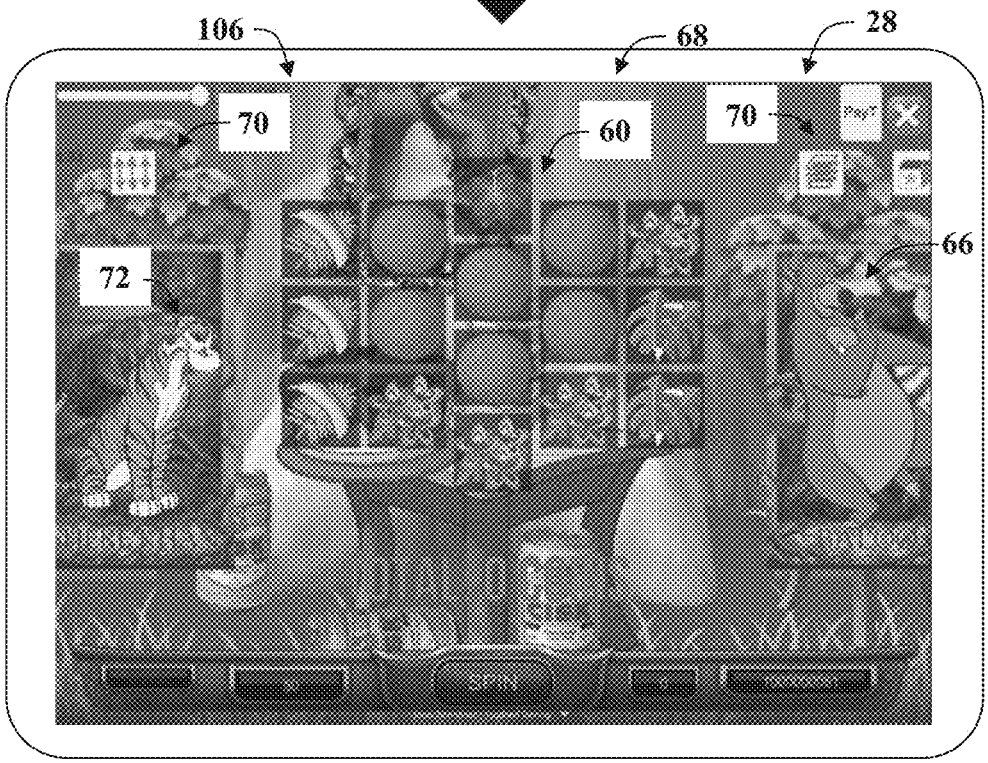
Figure 7A:
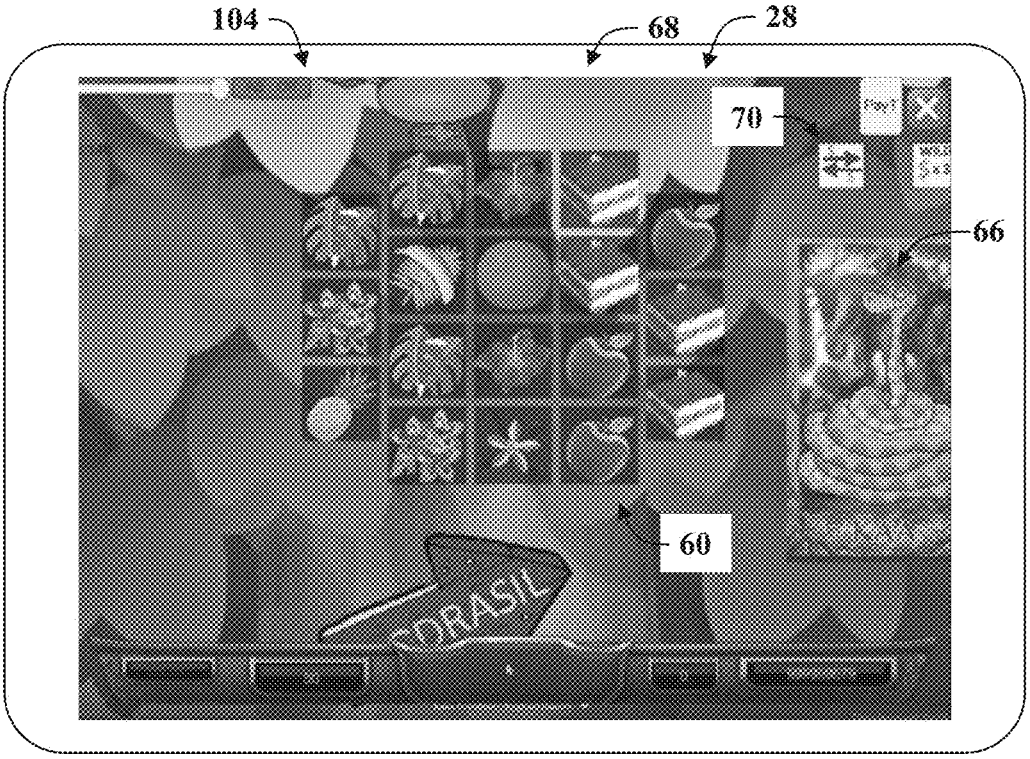
FIGS. 7A-7B illustrate another sequence of graphical displays of the game show in FIG. 6, according to an embodiment of the present invention.

For example, referring to FIGS. 6A-6B, in one embodiment, the gaming controller 74 may display a first instance 104 of the game 28 with a host character reel feature set only. As shown in FIG. 7A, for example, the first instance of the game 28 may include the Host Character B (e.g., Baloo) including the reel feature set including the Stacked Symbol feature and the Treasure Chest feature. The gaming controller 74 also displays the realm 68 including the 3×3×4×3×3 reel matrix associated with Host Character B. Upon completion of the first instance 104 of the game, the gaming controller 74 may initiate a second instance 106 of the game and randomly select a second reel combination that includes the current reel feature set and a guest bonus reel feature. The gaming controller 74 then selects the guest bonus feature associated with the current reel feature set, and displays the second instance 106 of the game with the current host feature set, current host character, the selected guest bonus reel feature, and guest character associated with the guest bonus reel feature. For example, as shown in FIGS. 6A and 6B, the gaming controller 74 displays an animated sequence of images that displays the guest Character C (Shere Khan) entering the realm 68 associated with the host Character B (Baloo) and being displayed with the 1 Sticky Respin feature symbol 70.

Figure 7B:
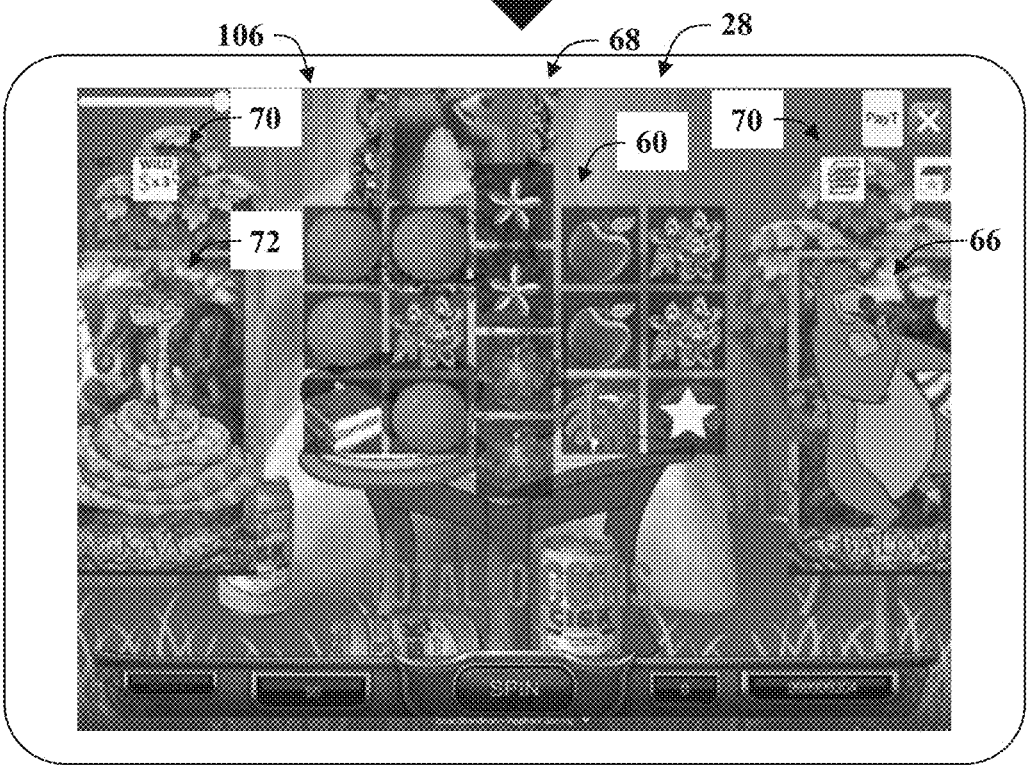

With reference to FIGS. 7A-7B, the gaming controller 74 may generate the first instance 104 with a host character reel feature set only and display the first instance 104 with the Host Character D (Kaa) including the reel feature set including the Win Both Ways feature and the ×3 Wild Multiplier feature and a reel matrix 60 including a 3×4×4×4×3 cell arrangement. Upon completion of the first instance 104 of the game, the gaming controller 74 may initiate a second instance 106 of the game and randomly select a second reel combination that includes a new reel feature set and a guest bonus reel feature that is selected from the previous reel feature set used in the first instance 104. For example, as shown in FIGS. 7A and 7B, the gaming controller 74 may select the new host reel feature set associated with Character B (Baloo), and display an animated sequence of images that displays the previous host Character D (Kaa) leaving the realm 68 associated with Kaa and moving to the realm 68 associated with host Character B (Baloo). The gaming controller 74 displays the realm 68 with the reel matrix associated with Character B, including the 3×3×4×3×3 cell arrangement, the Guest Character D, Kaa, displayed with the ×3 Wild Multiple feature symbol 70, and Host Character B (Baloo) being displayed with the Stacked Symbol feature symbol 70 and the Treasure Chest feature symbol 70.

In one embodiment, with reference to FIGS. 8A-8B, the gaming controller 74 may generate the first instance 104 with a host character reel feature set and a guest bonus reel feature. For example, as shown in FIG. 8A, the first instance 104 may include the Host Character B (Baloo) being displayed with the reel feature set including the Stacked Symbol feature symbol 70 and the Treasure Chest feature symbol 70, and the Guest Character D (Kaa) with the ×3 Wild Multiple feature symbol 70. Upon completion of the first instance 104 of the game, the gaming controller 74 may initiate a second instance 106 of the game and randomly select a second reel combination that includes a new reel feature set only. The gaming controller 74 may then select the reel feature set and the reel matrix associated with the Guest Character D, and display the second instance 106 with a new realm 68, reel matrix 60, and reel feature set associated with the new Host Character D (Kaa). For example, as shown in FIGS. 8A and 8B, the gaming controller 74 may display an animated sequence of images that displays the game screen transitioning from the realm 68 of the previous host Character B (Baloo) and moving to the realm 68 of the new Host Character D (Kaa), including the corresponding reel matrix 60 (3×4×4×4×3 cell arrangement) and the Win Both Ways feature symbol 70 and the ×3 Wild Multiplier feature symbol 70.

In method step 218, the gaming controller 74 generates an outcome of the second instance of the game using the selected second reel feature combination.

In method step 220, the gaming controller 74 displays the outcome of the second instance of the game 28 by spinning and stopping the reels to display the game outcome.

A controller, computing device, server or computer, such as described herein, includes at least one or more processors or processing units and a system memory (see above). The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. In addition, a central processing unit (CPU) may include one or more processors as described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine, comprising:

a display device configured to display a game to a player using computer generated graphics;

an user input device configured to receive inputs from the player to allow the player to operate the gaming machine to initiate instances of the game;

a database including a reel feature selection table including a plurality of reel feature set records, each reel feature set record including information associated with a reel matrix, a reel feature set including at least two different reel features, a corresponding game character, and game character animations associated with each of the at least two different reel features, wherein each game character is different and each associated game character animation is different;

a controller including a processor coupled to the database, the processor programmed to display a game on the display device that includes a plurality of simulated rotatable reels being displayed on a game screen, the processor is configured to display the plurality of simulated rotatable reels be executing algorithm steps to:

initiate a first instance of the game upon receiving a request from the player via the input device;

access the reel feature selection table being stored in the database and select a first primary reel feature set from the reel feature selection table, and generate a first reel feature combination including the selected first primary reel feature set for use with the first instance of the game;

identify a corresponding reel matrix, a host game character, and host game character animations included with the selected first primary reel feature set;

display the game on the display device including computer-generated images of the plurality of simulated rotatable reels including a plurality of symbols displayed within the corresponding reel matrix, and the host game character;

randomly generate an outcome of the first instance of the game including reel features included in the selected first primary reel feature set; and display the outcome on the display device by spinning and stopping the plurality of simulated rotatable reels based on the reel features of the first primary feature set and animating the host game character based on the corresponding host game character animations.

2. The gaming machine of claim 1, wherein the controller is configured to:

initiate a second instance of the game;

generate a second reel feature combination as a function of the first reel feature combination; and generate an outcome of the second instance of the game using the second reel feature combination.

3. The gaming machine of claim 2, wherein the controller is configured to:

access the reel feature selection table and select a bonus reel feature that is associated with the first primary reel feature set; and generate the second reel feature combination including the first primary reel feature set and the selected bonus reel feature.

4. The gaming machine of claim 2, wherein the controller is configured to:

select a bonus reel feature from the first primary reel feature set;

access the reel feature selection table and select a second primary reel feature set associated with the selected bonus reel feature; and generate the second reel feature combination including the selected second primary reel feature set and the selected bonus feature.

5. The gaming machine of claim 2, wherein the first reel feature combination includes the first primary reel feature set and a bonus reel feature, the controller is configured to generate the second reel feature combination including only the first primary reel feature set.

6. The gaming machine of claim 2, wherein the first reel feature combination includes the first primary reel feature set and a bonus reel feature, the controller is configured to:

access the reel feature selection table and select a second primary reel feature set associated with the bonus reel feature; and generate the second reel feature combination including only the second primary reel feature set.

7. The gaming machine of claim 1, wherein the controller is configured to:

access the reel feature selection table and select a first bonus reel feature associated with the selected first primary reel feature set; and generate the outcome of the first instance of the game including the first primary reel feature set and the selected first bonus reel feature set.

8. The gaming machine of claim 2, wherein the controller is configured to:

generate a feature combination selection table including a plurality of feature groups associated with the first reel feature combination; and randomly select one of the plurality of feature groups to generate the second reel feature combination.

9. The gaming machine of claim 1, wherein at least two of the reel feature sets included in the reel feature selection table include different reel matrices.

10. A method of operating a machine including a display device, a user input device, and a controller, the method comprising the controller performing the steps of:

generating a reel feature selection table stored in a database, the reel feature selection table including a plurality of eel feature set records, each reel feature set record including information associated with a reel matrix, a reel feature set including at least two different reel features, a corresponding game character, and game character animations associated with each of the at least two different reel features, wherein each game character is different and each associated game character animation is different;

initiating a first instance of the game upon receiving a request from the player via the user input device;

accessing the reel feature selection table being stored in the database and selecting a first primary reel feature set from the reel feature selection table, and generating a first reel feature combination including the selected first primary reel feature set for use with the first instance of the game;

identifying a corresponding reel matrix, a host game character, and host game character animations included with the selected first primary reel feature set;

displaying the game on the display device including computer-generated images of a plurality of simulated rotatable reels including a plurality of symbols displayed within the corresponding reel matrix, and the host game character;

randomly generating an outcome of the first instance of the game including reel features included in the selected first primary reel feature set; and displaying the outcome on the display device by spinning and stopping the plurality of simulated rotatable reels based on the reel features of the first primary feature set and animating the host game character based on the corresponding host game character animations.

11. The method of claim 10, including the steps of:

initiating a second instance of the game;

generating a second reel feature combination as a function of the first reel feature combination; and generating an outcome of the second instance of the game using the second reel feature combination.

12. The method of claim 11, including the steps of:

accessing the reel feature selection table and select a bonus reel feature that is associated with the first primary reel feature set; and generating the second reel feature combination including the first primary reel feature set and the selected bonus reel feature.

13. The method of claim 11, including the steps of:

selecting a bonus reel feature from the first primary reel feature set;

accessing the reel feature selection table and select a second primary reel feature set associated with the selected bonus reel feature; and generating the second reel feature combination including the selected second primary reel feature set and the selected bonus feature.

14. The method of claim 11, wherein the first reel feature combination includes the first primary reel feature set and a bonus reel feature, the method includes the step of generating the second reel feature combination including only the first primary reel feature set.

15. The method of claim 11, wherein the first reel feature combination includes the first primary reel feature set and a bonus reel feature, the method includes the steps of:

accessing the reel feature selection table and select a second primary reel feature set associated with the bonus reel feature; and generating the second reel feature combination including only the second primary reel feature set.

16. The method of claim 10, wherein at least two of the reel feature sets included in the reel feature selection table include different reel matrices.

17. One or more non-transitory computer-readable storage media, having computer-executable instructions embodied thereon, wherein when executed by at least one processor, the computer-executable instructions cause processor to:

generate a reel feature selection table stored in a database, the reel feature selection table including a plurality of eel feature set records, each reel feature set record including information associated with a reel matrix, a reel feature set including at least two different reel features, a corresponding game character, and game character animations associated with each of the at least two different reel features, wherein each game character is different and each associated game character animation is different;

initiate a first instance of the game upon receiving a request from the player via the input device;

access the reel feature selection table being stored in the database and select a first primary reel feature set from the reel feature selection table, and generate a first reel feature combination including the selected first primary reel feature set for use with the first instance of the game;

identify a corresponding reel matrix, a host game character, and host game character animations included with the selected first primary reel feature set display the game on the display device computer-generated images of a plurality of simulated rotatable reels including a plurality of symbols displayed within the corresponding reel matrix, and the host game character;

randomly generate an outcome of the first instance of the game including reel features included in the selected first primary reel feature set; and display the outcome on the display device by spinning and stopping the plurality of reels based on the reel features of the first primary feature set and animating the host game character based on the corresponding host game character animations.

18. The one or more computer-readable storage media of claim 17, wherein the computer-executable instructions cause the processor to:

initiate a second instance of the game;

generate a second reel feature combination as a function of the first reel feature combination; and generate an outcome of the second instance of the game using the second reel feature combination.

19. The one or more computer-readable storage media of claim 18, wherein the computer-executable instructions cause the processor to:

access the reel feature selection table and select a bonus reel feature that is associated with the first primary reel feature set; and generate the second reel feature combination including the first primary reel feature set and the selected bonus reel feature.

20. The one or more computer-readable storage media of claim 18, wherein the computer-executable instructions cause the processor to:

select a bonus reel feature from the first primary reel feature set;

access the reel feature selection table and select a second primary reel feature set associated with the selected bonus reel feature; and generate the second reel feature combination including the selected second primary reel feature set and the selected bonus feature.

* * * * *